US009840358B2

(12) United States Patent
Oliveira

(10) Patent No.: US 9,840,358 B2
(45) Date of Patent: Dec. 12, 2017

(54) CARTON WITH ARTICLE PROTECTION FEATURE

(71) Applicant: Graphic Packaging International, Inc., Atlanta, GA (US)

(72) Inventor: Steven M. Oliveira, Canton, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 1024 days.

(21) Appl. No.: 13/803,817

(22) Filed: Mar. 14, 2013

(65) Prior Publication Data

US 2014/0260095 A1 Sep. 18, 2014

(51) Int. Cl.
*B65D 5/50* (2006.01)
*B65D 71/36* (2006.01)

(52) U.S. Cl.
CPC ..... *B65D 71/36* (2013.01); *B65D 2571/0045* (2013.01); *B65D 2571/0066* (2013.01); *B65D 2571/00141* (2013.01); *B65D 2571/00265* (2013.01); *B65D 2571/00728* (2013.01)

(58) Field of Classification Search
CPC ..... B65D 5/5007; B65D 71/36; B65D 2571/00814; B65D 5/445
USPC ..... 206/427, 433, 784, 139, 194, 197; 229/198.2, 199, 122.32
See application file for complete search history.

(56) References Cited

U.S. PATENT DOCUMENTS

| | | | |
|---|---|---|---|
| 1,527,204 | A | 2/1925 | McCormick |
| 2,014,461 | A | 9/1935 | Anton |
| D112,844 | S | 1/1939 | Medoff |
| 2,196,502 | A | 4/1940 | Kells |
| 2,331,137 | A | 10/1943 | Rous |
| 2,877,894 | A | 3/1959 | Forrer |
| 2,899,051 | A | 8/1959 | Barnby |

(Continued)

FOREIGN PATENT DOCUMENTS

| | | | |
|---|---|---|---|
| BE | 672 492 | A | 3/1966 |
| EP | 0 024 782 | A1 | 3/1981 |

(Continued)

OTHER PUBLICATIONS

Supplementary European Search Report for EP 12 78 2928 dated Mar. 11, 2015.

(Continued)

*Primary Examiner* — Christopher Demeree
(74) *Attorney, Agent, or Firm* — Womble Bond Dickinson (US) LLP

(57) ABSTRACT

A carton for containing at least one article. The carton comprises a plurality of panels at least partially forming an interior of the carton. The plurality of panels comprises a first panel and a second panel, the first panel and the second panel being in face-to-face contact to at least partially form the interior of the carton. The first panel comprises at least one article protection flap for protecting the at least one article. The at least one article protection flap is foldably connected to the first panel and moveable between a first position that is substantially parallel to the first panel and a second position wherein the article protection flap is folded relative to the first panel. The second panel comprises at least one access feature for positioning the at least one article protection flap from the first position to the second position.

27 Claims, 13 Drawing Sheets

(56) References Cited

U.S. PATENT DOCUMENTS

| | | | |
|---|---|---|---|
| 2,926,782 | A | 3/1960 | Andre |
| 2,933,867 | A | 4/1960 | Gentry |
| 2,974,454 | A | 3/1961 | Andre et al. |
| 3,013,796 | A | 12/1961 | Currie, Jr. et al. |
| 3,015,923 | A | 1/1962 | Dotzenroth |
| 3,016,663 | A | 1/1962 | Holmes |
| 3,032,945 | A | 5/1962 | Currie, Jr. et al. |
| 3,034,270 | A | 5/1962 | Nigrelli et al. |
| 3,045,401 | A | 7/1962 | Ganz |
| 3,108,414 | A | 10/1963 | Schleicher et al. |
| 3,128,034 | A | 4/1964 | Weiss |
| 3,142,378 | A | 7/1964 | Lengsfield, Jr. |
| 3,152,688 | A | 10/1964 | Mahon |
| 3,166,879 | A | 1/1965 | Chidsey, Jr. et al. |
| 3,167,214 | A | 1/1965 | Mahon |
| 3,176,902 | A | 4/1965 | Champlin |
| 3,186,136 | A | 6/1965 | Ganz |
| 3,190,193 | A | 6/1965 | Randles, Jr. |
| 3,196,588 | A | 7/1965 | Chidsey, Jr. |
| 3,197,937 | A | 8/1965 | Ganz |
| 3,203,153 | A | 8/1965 | Wood |
| 3,206,097 | A | 9/1965 | Holmes |
| 3,229,892 | A | 1/1966 | Weiss |
| 3,252,649 | A | 5/1966 | Graser et al. |
| 3,253,381 | A | 5/1966 | Wood |
| 3,255,919 | A | 6/1966 | Koolnis |
| RE26,083 | E | 9/1966 | Forrer |
| 3,300,947 | A | 1/1967 | Fahrenbach |
| 3,306,519 | A | 2/1967 | Wood |
| 3,332,199 | A | 7/1967 | Wong |
| 3,337,043 | A | 8/1967 | Parker |
| D208,591 | S | 9/1967 | Bozek |
| 3,355,012 | A | 11/1967 | Weiss |
| D209,786 | S | 1/1968 | Schwartz |
| 3,367,557 | A | 2/1968 | Farquhar |
| 3,385,429 | A | 5/1968 | Becker |
| 3,386,570 | A | 6/1968 | Lock |
| 3,386,643 | A | 6/1968 | Gentry |
| 3,387,428 | A | 6/1968 | Currie, Jr. |
| 3,415,033 | A | 12/1968 | Perry et al. |
| 3,432,029 | A | 3/1969 | Brown |
| 3,474,590 | A | 10/1969 | Ganz |
| 3,478,951 | A | 11/1969 | Graser |
| 3,517,876 | A | 6/1970 | Stout |
| D219,135 | S | 11/1970 | Horblitt |
| 3,543,473 | A | 12/1970 | Cato |
| 3,543,474 | A | 12/1970 | Hasselo |
| 3,572,003 | A | 3/1971 | Perry et al. |
| 3,604,614 | A | 9/1971 | Sternfeld |
| 3,627,193 | A | 12/1971 | Helms |
| 3,640,448 | A | 2/1972 | Wood |
| 3,669,342 | A | 6/1972 | Funkhouser |
| 3,670,950 | A | 6/1972 | Rossi |
| 3,679,121 | A | 7/1972 | Morgese |
| 3,687,282 | A | 8/1972 | Owen |
| 3,701,231 | A | 10/1972 | Standley |
| 3,715,029 | A | 2/1973 | Wood |
| 3,747,801 | A | 7/1973 | Graser |
| 3,760,555 | A | 9/1973 | Calvert |
| 3,767,042 | A | 10/1973 | Ganz |
| 3,788,538 | A | 1/1974 | Kuenzi |
| 3,797,729 | A | 3/1974 | Holmes |
| 3,815,320 | A | 6/1974 | Ganz |
| 3,897,872 | A | 8/1975 | Graser |
| 3,921,895 | A | 11/1975 | Ziche |
| 3,940,907 | A | 3/1976 | Ganz |
| 3,942,631 | A | 3/1976 | Sutherland et al. |
| 3,952,633 | A | 4/1976 | Nakai |
| 3,963,121 | A | 6/1976 | Kipp |
| 3,977,518 | A | 8/1976 | Arneson |
| 3,986,319 | A | 10/1976 | Puskarz |
| 4,012,887 | A | 3/1977 | Calvert et al. |
| 4,029,204 | A | 6/1977 | Manizza |
| 4,034,852 | A | 7/1977 | Forrer |
| 4,056,223 | A | 11/1977 | Williams |
| 4,093,068 | A | 6/1978 | Smrt |
| 4,093,116 | A | 6/1978 | Watkins et al. |
| 4,095,693 | A | 6/1978 | Killy |
| 4,095,735 | A | 6/1978 | Stone |
| 4,101,069 | A | 7/1978 | Wood |
| 4,131,230 | A | 12/1978 | Koehlinger et al. |
| 4,146,168 | A | 3/1979 | Hartline |
| 4,184,626 | A | 1/1980 | Graser |
| 4,185,744 | A | 1/1980 | Peterson |
| 4,186,867 | A | 2/1980 | Wood |
| 4,202,446 | A | 5/1980 | Sutherland |
| 4,219,147 | A | 8/1980 | Kohler |
| 4,234,081 | A | 11/1980 | Champlin |
| 4,256,226 | A | 3/1981 | Stone |
| 4,274,187 | A | 6/1981 | Painter et al. |
| 4,285,185 | A | 8/1981 | Collura et al. |
| 4,295,562 | A | 10/1981 | Wood |
| 4,324,328 | A | 4/1982 | Champlin |
| 4,328,891 | A | 5/1982 | Elward |
| 4,330,079 | A | 5/1982 | Wood |
| 4,338,760 | A | 7/1982 | Kuhn |
| 4,373,630 | A | 2/1983 | Oliff |
| 4,394,903 | A | 7/1983 | Bakx |
| 4,396,118 | A | 8/1983 | Watson |
| 4,398,631 | A | 8/1983 | Graser |
| 4,421,232 | A | 12/1983 | Konaka |
| 4,424,901 | A | 1/1984 | Lanier |
| 4,437,569 | A | 3/1984 | Sorenson |
| 4,437,606 | A | 3/1984 | Graser |
| 4,438,843 | A | 3/1984 | Graser |
| 4,463,852 | A | 8/1984 | Stone |
| 4,465,180 | A | 8/1984 | Klygis |
| 4,470,503 | A | 9/1984 | Stone |
| D275,837 | S | 10/1984 | Poelvoorde |
| 4,498,581 | A | 2/1985 | Dutcher |
| 4,498,618 | A | 2/1985 | Sutherland |
| 4,505,696 | A | 3/1985 | Wright et al. |
| 4,512,135 | A | 4/1985 | Scott et al. |
| 4,512,755 | A | 4/1985 | Stone |
| 4,533,047 | A | 8/1985 | Calvert |
| 4,545,485 | A | 10/1985 | Oliff |
| 4,571,923 | A | 2/1986 | Le Bras |
| 4,574,997 | A | 3/1986 | Ikeda |
| 4,597,523 | A | 7/1986 | Schuster |
| 4,600,140 | A | 7/1986 | Milliens |
| 4,612,753 | A | 9/1986 | Taylor et al. |
| 4,708,284 | A | 11/1987 | Sutherland et al. |
| 4,723,699 | A | 2/1988 | Brown et al. |
| D297,414 | S | 8/1988 | Feuerstein |
| 4,773,533 | A | 9/1988 | Greene |
| 4,883,168 | A | 11/1989 | Dreyfus |
| 4,890,737 | A | 1/1990 | Kadleck et al. |
| 4,890,738 | A | 1/1990 | Carer |
| 4,901,849 | A | 2/1990 | Wilson |
| 4,919,266 | A | 4/1990 | McIntosh, Jr. et al. |
| 4,925,019 | A | 5/1990 | Ganz et al. |
| 5,002,186 | A | 3/1991 | Cooper |
| 5,002,225 | A | 3/1991 | Bienaime |
| D316,672 | S | 5/1991 | Wood |
| 5,020,668 | A | 6/1991 | Schuster |
| 5,022,525 | A | 6/1991 | Schuster |
| 5,031,770 | A | 7/1991 | Chaussadas |
| 5,044,503 | A | 9/1991 | Wein |
| 5,080,280 | A | 1/1992 | Kraus |
| 5,094,347 | A | 3/1992 | Schuster |
| 5,107,986 | A | 4/1992 | Cooper |
| 5,131,588 | A | 7/1992 | Oliff |
| 5,140,803 | A | 8/1992 | Biggs et al. |
| D329,199 | S | 9/1992 | Corso |
| 5,145,067 | A | 9/1992 | Carver |
| 5,158,177 | A | 10/1992 | Negelen et al. |
| 5,167,325 | A | 12/1992 | Sykora |
| 5,246,112 | A | 9/1993 | Stout et al. |
| 5,297,673 | A | 3/1994 | Sutherland |
| D346,326 | S | 4/1994 | Price, Sr. |
| 5,310,050 | A | 5/1994 | Sutherland |
| 5,311,984 | A | 5/1994 | Harris |
| 5,328,080 | A | 7/1994 | Holley, Jr. |
| 5,360,104 | A | 11/1994 | Sutherland |

(56) References Cited

U.S. PATENT DOCUMENTS 5,360,113 A 11/1994 Harris
5,385,234 A 1/1995 Stout et al.
5,390,784 A 2/1995 Sutherland
5,390,848 A 2/1995 Gungner et al.
5,402,889 A 4/1995 Hermann et al.
5,437,363 A 8/1995 Gungner
5,439,112 A 8/1995 De Guglielmo et al.
5,443,203 A 8/1995 Sutherland
5,472,090 A 12/1995 Sutherland
5,476,217 A 12/1995 Moncrief et al.
5,484,059 A 1/1996 Sutherland
5,485,915 A 1/1996 Harris
5,509,549 A 4/1996 Marandola
5,520,283 A 5/1996 Sutherland
5,524,756 A 6/1996 Sutherland
5,549,197 A 8/1996 Sutherland
5,577,365 A 11/1996 Reuteler
5,579,904 A 12/1996 Holley, Jr.
5,582,289 A 12/1996 Wright
5,592,804 A 1/1997 Reuteler
5,595,291 A 1/1997 Negelen
5,595,292 A 1/1997 Bates
5,595,299 A 1/1997 LeBras
5,605,228 A 2/1997 Baxter
5,620,094 A 4/1997 Naumann
5,638,659 A 6/1997 Moncrief et al.
5,638,956 A 6/1997 Sutherland
5,653,340 A 8/1997 Daniel
5,664,401 A 9/1997 Portrait et al.
5,669,203 A 9/1997 Muller
5,671,587 A 9/1997 Robinson
5,671,845 A 9/1997 Harris
D385,791 S 11/1997 Forsyth
5,682,984 A 11/1997 Hoell
5,699,957 A 12/1997 Blin et al.
5,765,685 A 6/1998 Roosa
5,775,572 A 7/1998 Oliff
5,778,630 A 7/1998 Portrait et al.
5,927,053 A 7/1999 Donovan et al.
5,941,389 A 8/1999 Gomes
5,947,367 A 9/1999 Miller et al.
5,975,286 A 11/1999 Oliff
5,975,287 A 11/1999 Negelen
5,979,645 A 11/1999 Holley, Jr.
5,984,086 A 11/1999 Foushee et al.
6,044,627 A 4/2000 De Guglielmo
D424,435 S 5/2000 Koehn
D427,056 S 6/2000 Irace
6,149,002 A 11/2000 Tiramani et al.
6,155,412 A 12/2000 LeBras et al.
6,170,741 B1 1/2001 Skolik et al.
6,173,889 B1 1/2001 Sutherland
6,179,115 B1 1/2001 De Guglielmo et al.
6,186,931 B1 2/2001 Calvert et al.
6,189,687 B1 2/2001 Bakx
6,213,297 B1 4/2001 Gale
6,223,892 B1 5/2001 Bakx
6,241,083 B1 6/2001 Harrelson
6,247,585 B1 6/2001 Holley, Jr.
6,273,330 B1 8/2001 Oliff et al.
6,295,789 B1 10/2001 Muller
6,315,111 B1 11/2001 Sutherland
6,315,123 B1 11/2001 Ikeda
6,378,697 B1 4/2002 Sutherland
D462,264 S 9/2002 Barr
6,520,316 B2 2/2003 De Guglielmo et al.
6,527,102 B2 3/2003 De Guglielmo et al.
6,527,108 B1 3/2003 Blin et al.
6,536,656 B2 3/2003 Auclair et al.
6,615,984 B2 9/2003 Saulas et al.
6,662,933 B2 12/2003 De Guglielmo et al.
6,669,083 B2 12/2003 Bates
6,695,137 B2 2/2004 Jones et al.
6,877,600 B2 4/2005 Sutherland
6,896,129 B2 5/2005 Marco
6,896,130 B2 5/2005 Theelen
6,942,140 B2 9/2005 Merzeau
6,948,293 B1 9/2005 Eckermann et al.
6,983,874 B2 1/2006 Bakx
6,997,372 B2 2/2006 Gasparowicz
7,028,839 B2 4/2006 Belloli et al.
7,048,113 B2 5/2006 Gomes
7,055,671 B2 6/2006 De Guglielmo et al.
7,063,208 B2 6/2006 Lebras
7,070,045 B2 7/2006 Theelen
7,073,705 B2 7/2006 Auclair et al.
7,134,547 B2 11/2006 Auclair
D535,877 S 1/2007 Tanninen
7,175,020 B2 2/2007 Sutherland et al.
7,234,591 B2 6/2007 LeBras et al.
7,278,538 B2 10/2007 Chargueraud
7,374,038 B2 5/2008 Smalley
7,427,010 B2 9/2008 Sutherland
7,467,729 B2 12/2008 Lown et al.
7,699,215 B2 4/2010 Spivey, Sr.
7,703,666 B2 4/2010 Hand et al.
7,721,878 B2 5/2010 Requena
7,743,968 B2 * 6/2010 Theelen ..... B65D 71/36 229/117.13
7,780,067 B2 8/2010 Holley, Jr.
7,913,844 B2 3/2011 Spivey, Sr.
8,056,709 B2 11/2011 Sutherland
8,061,587 B2 11/2011 Blin
8,070,052 B2 12/2011 Spivey, Sr.
8,079,471 B2 12/2011 Tokarski et al.
D652,300 S 1/2012 Anderson
D658,060 S 4/2012 Anderson
8,162,135 B2 4/2012 Oliveira
8,376,214 B2 2/2013 Spivey et al.
8,453,919 B2 * 6/2013 Eckermann ..... B65D 71/36 229/117.13
D686,913 S 7/2013 Kirk
8,496,162 B2 * 7/2013 Hettinger ..... B65D 71/14 206/139
8,523,048 B1 9/2013 Spiegelman
D696,108 S 12/2013 De Pra
8,978,889 B2 3/2015 Fitzwater et al.
9,022,277 B2 5/2015 Hendricks
D740,116 S 10/2015 Sims
9,284,090 B2 3/2016 Lettre
D753,485 S 4/2016 Marsh
2001/0017315 A1 8/2001 Baroudi
2004/0000494 A1 1/2004 Sutherland
2004/0164135 A1 8/2004 Gong et al.
2007/0056869 A1 3/2007 Tokarski
2007/0181658 A1 8/2007 Sutherland
2007/0215682 A1 9/2007 Bates et al.
2007/0277481 A1 12/2007 LeBras
2008/0093366 A1 4/2008 McKahan
2008/0203143 A1 8/2008 Holley
2008/0257942 A1 10/2008 LeBras
2009/0032425 A1 2/2009 Perkinson
2009/0065559 A1 3/2009 Parkes
2009/0101526 A1 4/2009 Sutherland et al.
2009/0236408 A1 9/2009 Spivey, Sr. et al.
2010/0108544 A1 5/2010 Biundo
2010/0140336 A1 6/2010 Ho Fung
2011/0011924 A1 1/2011 Spivey, Sr. et al.
2011/0065558 A1 3/2011 Smalley
2011/0233091 A1 9/2011 Block et al.
2011/0284622 A1 11/2011 Boukredine
2011/0290867 A1 12/2011 Schemmel et al.
2012/0279897 A1 * 11/2012 Schmal ..... B65D 71/10 206/593
2013/0097974 A1 4/2013 Disrud et al.
2013/0220873 A1 8/2013 Holley, Jr.
2013/0284628 A1 * 10/2013 Moncrief ..... B31B 7/00 206/427
2014/0305825 A1 10/2014 Holley, Jr.
2014/0305826 A1 10/2014 Holley, Jr.

(56) References Cited

U.S. PATENT DOCUMENTS

| | | | |
|---|---|---|---|
| 2015/0001116 | A1 | 1/2015 | Schmal et al. |
| 2015/0048150 | A1 | 2/2015 | Bahr |

FOREIGN PATENT DOCUMENTS

| | | | |
|---|---|---|---|
| EP | 332 153 | B1 | 9/1991 |
| EP | 630 825 | A2 | 12/1994 |
| EP | 0 541 334 | B1 | 4/1995 |
| EP | 0 715 596 | B1 | 6/1995 |
| EP | 0 820 404 | B1 | 4/1996 |
| EP | 0 901 969 | B1 | 4/2000 |
| EP | 1 065 151 | A1 | 1/2001 |
| EP | 0 954 470 | B1 | 9/2002 |
| EP | 1 103 481 | B1 | 8/2004 |
| EP | 1 010 637 | B1 | 9/2004 |
| EP | 1 125 858 | B1 | 9/2004 |
| EP | 1 381 545 | B1 | 10/2005 |
| EP | 1 334 043 | B1 | 12/2005 |
| EP | 1 151 935 | B1 | 8/2006 |
| EP | 1 513 737 | B1 | 11/2006 |
| EP | 2 055 648 | A1 | 5/2009 |
| EP | 1 749 755 | B1 | 12/2011 |
| FR | 2584677 | | 1/1987 |
| FR | 2619363 | | 2/1989 |
| FR | 2 641 523 | A1 | 7/1990 |
| FR | 2684078 | | 5/1993 |
| GB | 1 049 429 | A | 11/1966 |
| JP | S43-022550 | | 9/1943 |
| JP | H05-330502 | | 12/1993 |
| JP | H11-503693 | | 3/1999 |
| JP | 11-124129 | A | 5/1999 |
| JP | 3039805 | | 3/2000 |
| JP | 2008 213894 | A | 9/2008 |
| JP | 2009-120248 | | 6/2009 |
| KR | 20-2010-0010124 | | 10/2010 |
| WO | WO 92/09498 | | 6/1992 |
| WO | WO 93/14991 | A1 | 8/1993 |
| WO | WO 95/08489 | A1 | 3/1995 |
| WO | WO 96/32322 | | 10/1996 |
| WO | WO 2005/042370 | A1 | 5/2005 |
| WO | WO 2005/094471 | A2 | 10/2005 |
| WO | WO 2011/022145 | A1 | 2/2011 |
| WO | WO 2011/049947 | A1 | 4/2011 |
| WO | WO 2013/019753 | A1 | 2/2013 |

OTHER PUBLICATIONS

International Search Report and Written Opinion for PCT/US2013/030776 dated Jun. 27, 2013.

International Search Report and Written Opinion for PCT/US2012/029022 dated Sep. 26, 2012.

International Search Report and Written Opinion for PCT/US2013/031288 dated Jun. 13, 2013.

Supplementary European Search Report for EP 12 84 0937 dated Jun. 3, 2015.

International Search Report and Written Opinion for PCT/US2012/060948 dated Mar. 28, 2013.

International Search Report and Written Opinion for PCT/2014/037642 dated Sep. 5, 2014.

International Search Report and Written Opinion for PCT/2014/033445 dated Sep. 5, 2014.

Supplementary Partial EP Search Report for EP 12 78 2928 dated Nov. 28, 2014.

International Search Report and Written Opinion for PCT/US2013/031205 dated Nov. 26, 2013.

Supplementary European Search Report for EP 13 87 7522 dated Sep. 23, 2016.

Supplementary European Search Report for EP 14 78 2642 dated Oct. 25, 2016.

* cited by examiner

CARTON WITH ARTICLE PROTECTION FEATURE

INCORPORATION BY REFERENCE

The entire contents of U.S. patent application Ser. No. 13/419,740, filed Mar. 14, 2012, is hereby incorporated by reference as if presented herein in its entirety.

BACKGROUND OF THE DISCLOSURE

The present disclosure generally relates to cartons for holding beverage containers or other types of articles. More specifically, the present disclosure relates to cartons having an article protection flap and/or access feature that protects the containers or articles from breakage.

SUMMARY OF THE DISCLOSURE

In general, one aspect of the disclosure is directed to a carton for containing at least one article. The carton comprises a plurality of panels at least partially forming an interior of the carton. The plurality of panels comprises a first panel and a second panel, the first panel and the second panel being in face-to-face contact to at least partially form the interior of the carton. The first panel comprises at least one article protection flap for protecting the at least one article. The at least one article protection flap is foldably connected to the first panel and moveable between a first position that is substantially parallel to the first panel and a second position wherein the article protection flap is folded relative to the first panel. The second panel comprises at least one access feature for positioning the at least one article protection flap from the first position to the second position.

In another aspect, the disclosure is generally directed to a blank for forming a carton for containing at least one article. The blank comprises a plurality of panels for at least partially forming an interior of the carton formed from the blank. The plurality of panels comprising a first panel and a second panel, the first panel and the second panel are for being in face-to-face contact to at least partially form the interior of the carton formed from the blank. The first panel comprises at least one article protection flap for protecting the at least one article. The at least one article protection flap is foldably connected to the first panel and moveable between a first position that is substantially parallel to the first panel and a second position wherein the article protection flap is folded relative to the first panel.

In another aspect, the disclosure is generally direct to a method of forming a carton. The method comprises obtaining a blank comprising a plurality of panels comprising a first panel and a second panel. The first panel comprising at least one article protection flap foldably connected to the first panel, and the second panel comprising at least one access feature. The method comprises positioning the plurality of panels to at least partially form an interior of the carton comprising positioning the first panel and the second panel to be in face-to-face contact, and loading the at least one article in the interior of the carton. The method further comprises accessing the at least one article protection flap through the access feature and folding the at least one article protection flap relative to the first panel after the loading the at least one article. The folding comprises moving the article protection flap from a first position that is substantially parallel to the first panel to a second position wherein the article protection flap is folded relative to the first panel.

Other aspects, features, and details of the present disclosure can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to cartons that contain a single article or a plurality of articles such as containers, bottles, cans, etc., and protection features of such cartons that protect the article or articles or containers from breakage, damage, or deformation. The article(s) can be used for packaging food and beverage products, for example, or any other item. The article(s) can be made from materials suitable in composition for packaging the particular food or beverage item, or other item, and the materials can include, but are not limited to, glass or other breakable material; aluminum and/or other metals; plastics such as PET, LDPE, LLDPE, HDPE, PP, PS, PVC, EVOH, and Nylon; paperboard; and the like, or any combination thereof, or any other suitable material.

Cartons according to the present disclosure can accommodate articles of any shape. For the purpose of illustration and not for the purpose of limiting the scope of the disclosure, the following detailed description describes food product containers (e.g., glass jars or beverage bottles) as disposed within the carton embodiments. The containers could also be beverage containers (e.g., glass beverage bottles) without departing from the disclosure. In this specification, the terms "lower," "bottom," "upper" and "top" indicate orientations determined in relation to fully erected and upright cartons.

Figure 1:
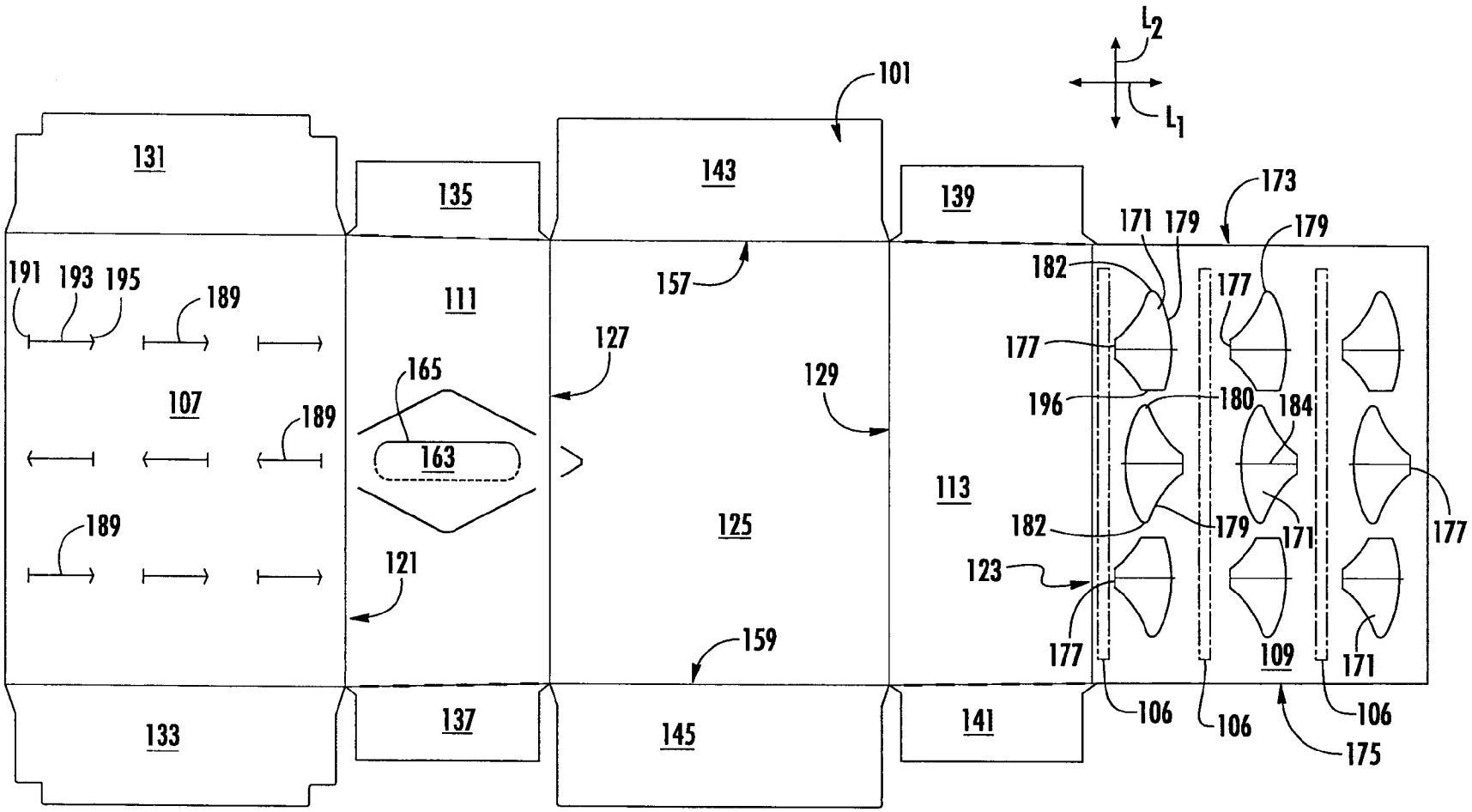
FIG. 1 is a plan view of an exterior surface of a blank for forming a carton according to a first embodiment of the disclosure.
Figure 5:
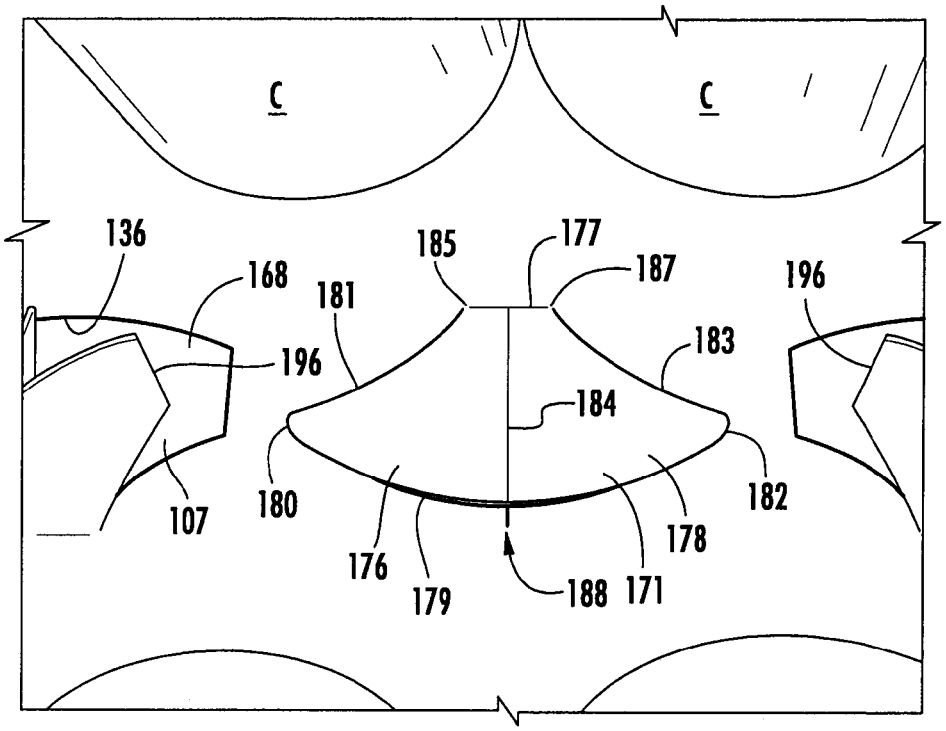
FIG. 5 is a perspective view of an interior surface of the bottom panel of the carton of the first embodiment showing article protection flaps.

FIG. 1 is a plan view of the exterior side 101 of a blank, generally indicated at 103, used to form a carton 105 (FIG. 3) according to a first exemplary embodiment of the disclosure. The carton 105 can be used to house a plurality of articles such as containers C (FIG. 5). In the illustrated embodiment, the containers C are glass containers. In the illustrated embodiment, the carton 105 is sized to house twelve containers C in a single layer in a 3×4 arrangement, but it is understood that the carton 105 may be sized and shaped to hold containers of a different or same quantity in more than one layer and/or in different row/column arrangements (e.g., 1×6, 2×6, 4×6, 3×8, 2×6×2, 3×4×2, 2×9, 3×4, etc.), or just a single article.

The blank 103 has a longitudinal axis L1 and a lateral axis L2. In the embodiment of FIG. 1, the blank includes a first bottom panel 109 and a second bottom panel 107. The second bottom panel 107 foldably connected to a first side panel 111 at a lateral fold line 121. The first bottom panel 109 is foldably connected to a second side panel 113 at a lateral fold line 123. A top panel 125 is foldably connected to the first side panel 111 at a lateral fold line 127, and foldably connected to the second side panel 113 at a lateral fold line 129.

The second bottom panel 107 is foldably connected to a first bottom end flap 131 and a second bottom end flap 133. The first side panel 111 is foldably connected to a first side end flap 135 and a second side end flap 137. The second side panel 113 is foldably connected to a first side end flap 139 and a second side end flap 141. The top panel 125 is foldably connected to a first top end flap 143 and a second top end flap 145. In one embodiment, when the carton 105 is erected, the end flaps 131, 135, 139, 141, close the first end 151 of the carton 105, and the end flaps 133, 137, 141, 145 close the second end 153 of the carton 105. In accordance with an alternative embodiment of the present disclosure, different flap arrangements can be used for closing the ends 151, 152 of the carton 105.

The end flaps 131, 135, 139, 141 extend along a first marginal area of the blank 103, and are foldably connected at a first longitudinal fold line 157 that extends along the length of the blank. The end flaps 133, 137, 141, 145 extend along a second marginal area of the blank 103, and are foldably connected at a second longitudinal fold line 159 that also extends along the length of the blank 103. The longitudinal fold lines 157, 159 may be, for example, substantially straight, or offset at one or more locations to account for blank thickness or for other factors.

In the embodiment of FIG. 1, the blank 103 has handle features for forming a handle 161. In the illustrated embodiment, the handle features comprise a handle flap 163 foldably connected to a respective first side panel 111 at a longitudinal fold line 165. The blank 103 can have other features for forming the handle 161, or the blank and/or carton 105 can have a handle that is alternatively shaped, arranged, and/or configured without departing from the disclosure. Further, the handle 161 can be omitted without departing from the disclosure.

In the first embodiment, the blank 103 includes nine article protection flaps 171 arranged in a 3×3 arrangement in the first bottom panel 109, but the blank 103 could have more or less than nine article protection flaps 171, and the flaps could be otherwise arranged in other suitable row/column arrangements or in a random configuration on the first bottom panel 109, including a single row or single column configuration, or any other suitable configuration. In the embodiment of FIG. 1, the middle row of article protection flaps 171 are oriented 180 degrees relative to a row of article protection flaps that are closer to side edges 173, 175. In other embodiments, the article protection flaps 171 could be otherwise shaped, arranged, and/or configured without departing from the disclosure.

As shown in FIGS. 1 and 5, the article protection flaps 171 are each foldably connected to the second bottom panel 109 at a respective lateral fold line 177 and are each at least partially defined by a line of weakening 179 in the first bottom panel 109. In one embodiment, the line of weakening 179 is a cut, but the line of weakening could comprises other forms of weakening (e.g., a tear line that comprises cut lines separated by breakable nicks, a tear line that is formed by a series of spaced apart cuts, etc.) that allows the article protection flap 171 to separate from the bottom panel 109 without departing from the disclosure. As shown in FIG. 5, the cut 179 has a first portion 181 that is generally curved and extending from a first end 185 of the fold line 177 and a second portion 183 that is generally curved and extending from a second end 187 of the fold line 177. Both the first portion 181 and the second portion 183 of the cut 179 extend away from the fold line 177 and form a respective rounded corner 180, 182 of the cut 179. As shown in FIGS. 1 and 5, the article protection flap 171 comprises a second fold line 184 extending from the middle of the first fold line 177. A first portion 176 and a second portion 178 of the article protection flap 171 are foldably connected along the second fold line 184. In one embodiment, a slit or cut 188 is positioned adjacent the second fold line 184. In the first embodiment, the second fold line 184 is a longitudinal fold line that is generally parallel to and extends in the longitudinal direction L1 of the blank 103. The fold lines 177, 184, and cuts 179, 188 could be otherwise shaped, arranged, configured, and/or omitted such that the article protection flap 171 has any other suitable shape or configuration without departing from the disclosure.

In one embodiment, the blank 103 includes nine access features 189 for positioning the article protection flaps 171 to a second position while substantially covering the apertures 168 formed from the activation of the article protection flaps 171. The access feature 189 also helps prevent foreign matter from entering the carton 103 while the article protection flaps 171 are activated. The access features 189 are arranged in a 3×3 arrangement, but the blank 103 could have more or less than nine access features 189, and the access features could be otherwise arranged in other suitable row/column arrangements or in a random configuration on the first bottom panel 107, including a single row or single column configuration, or any other suitable configuration. In the embodiment of FIG. 1, the middle row of access features are oriented 180 degrees relative to a row of access features that are closer to a respective fold line 157, 159. In other embodiments, the access features could be otherwise shaped, arranged, and/or configured without departing from the disclosure.

Figure 4:
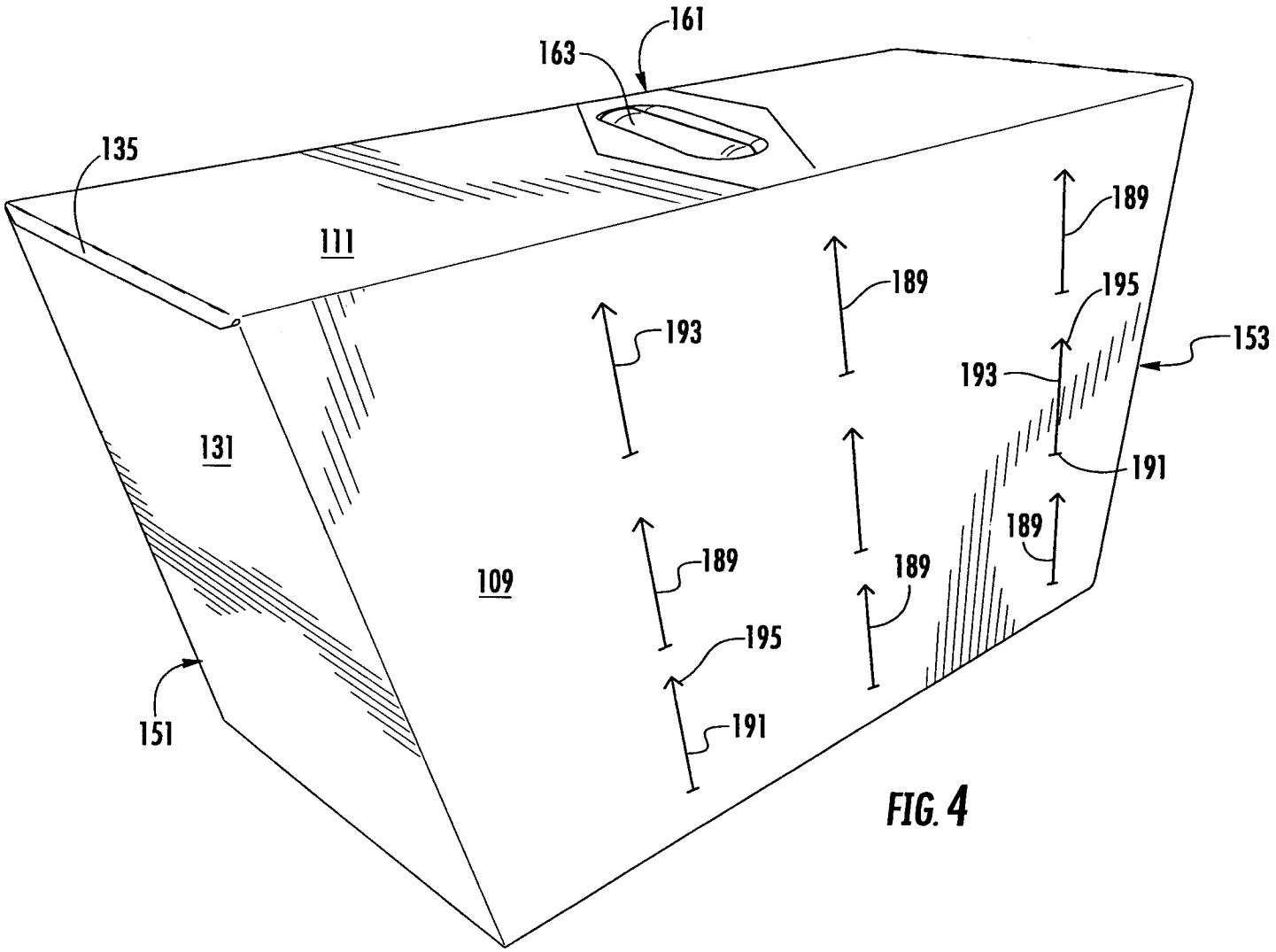
FIG. 4 is a side perspective of an assembled carton of the first embodiment.

As shown in FIGS. 1 and 4, the access features 189 are at least partially defined by a line of weakening with three portions 191, 193, and 195; however the access feature 189 can comprise more or less lines of weakening without departing form the disclosure. In one embodiment, the lines of weakening are cuts, but the line of weakening could comprises other forms of weakening (e.g., a tear line that comprises cut lines separated by breakable nicks, a tear line that is formed by a series of spaced apart cuts, an opening, etc.) that allows the access feature 189 to open without departing from the disclosure. The access feature 189 has a first portion 191 that is generally straight and extending the length of and in alignment with lateral fold line 177 of the article protection flaps 171. The access feature 189 has a second portion 193 that is generally straight and extends perpendicular from the center of the first portion 191. The third portion 195 of the access feature 189 is generally oblique and extends from the edge of the second portion 193 toward the first portion 191. In other embodiments, the blank 103 can include access features 189 that are different, similar, or identical to the access features without departing from the disclosure.

Figure 2:
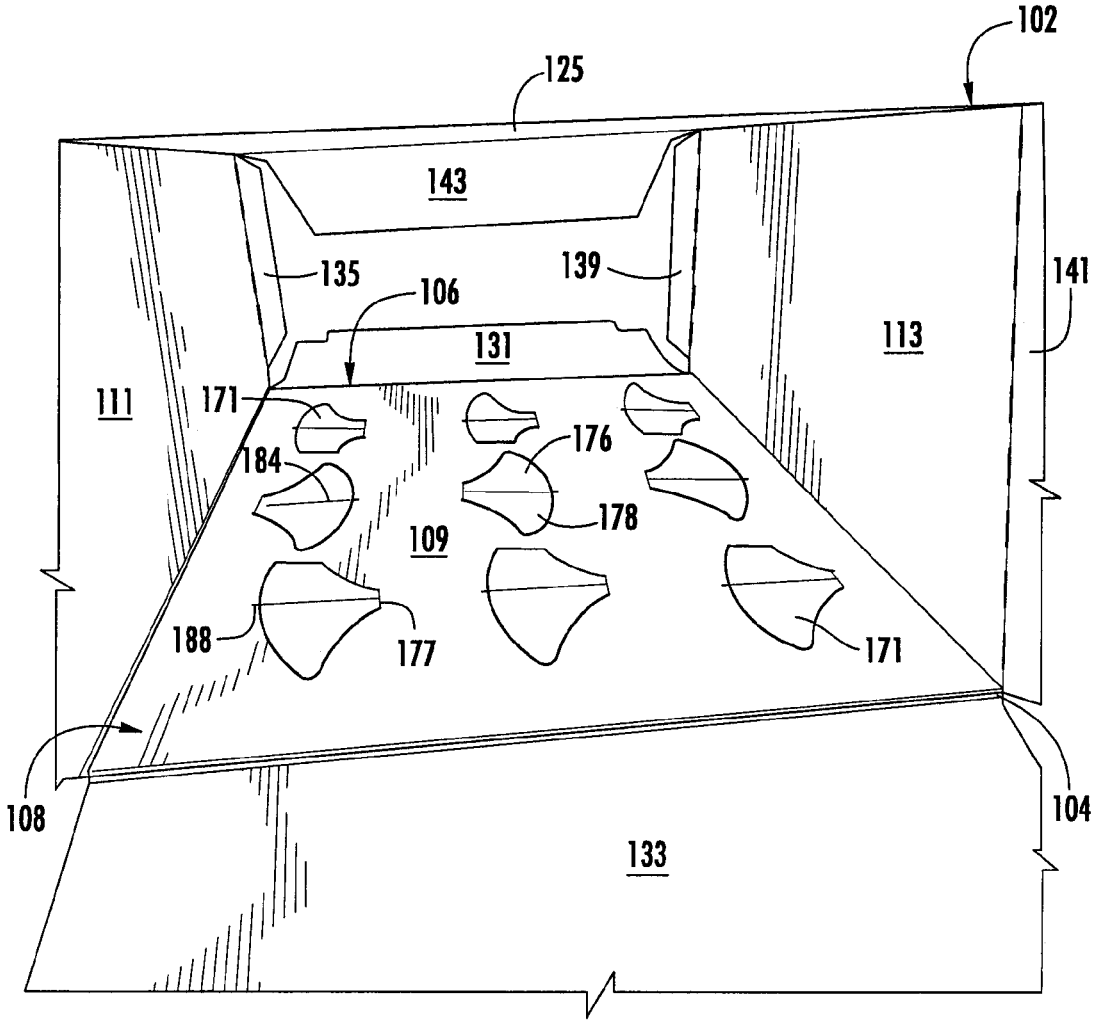
FIG. 2 is an end perspective of the partially assembled carton of the first embodiment.

FIGS. 2-7 show one exemplary method of forming the carton 105 and the article protection features 171. At various stages of the erecting process, glue or other adhesive can be applied to various portions of the blank 103. As shown in FIG. 2, the blank 103 can be formed into a sleeve 102 having open ends 104, 106 by folding the first bottom panel 109, second bottom panel 107, side panels 111, 113, and top panel 125 along respective fold lines 121, 123, 127, 129. The first bottom panel 109 and second bottom panel 107 are positioned in face-to-face contact to form an interior of the carton 105. The access features 189 are positioned in registration with the article protection flaps 171. The first bottom panel 109 can be adhesively secured to the second bottom panel 107 by glue lines 106 or other suitable adhesive. Containers C can be placed into an interior space 108 of the sleeve 102. One of the ends 151, 153 can be closed prior to loading the containers C or both of the ends 151, 153 can be closed after loading the containers into the interior space 108. The closing of the first end 151 is described below, but it is understood that the second end 153 can be closed in a similar manner. Alternatively, the second end 153 could have different flap closing sequence or arrangement and the article protection features 171 and access features 189 could be otherwise shaped, arranged, configured, and/or omitted without departing from the disclosure.

Figure 3:
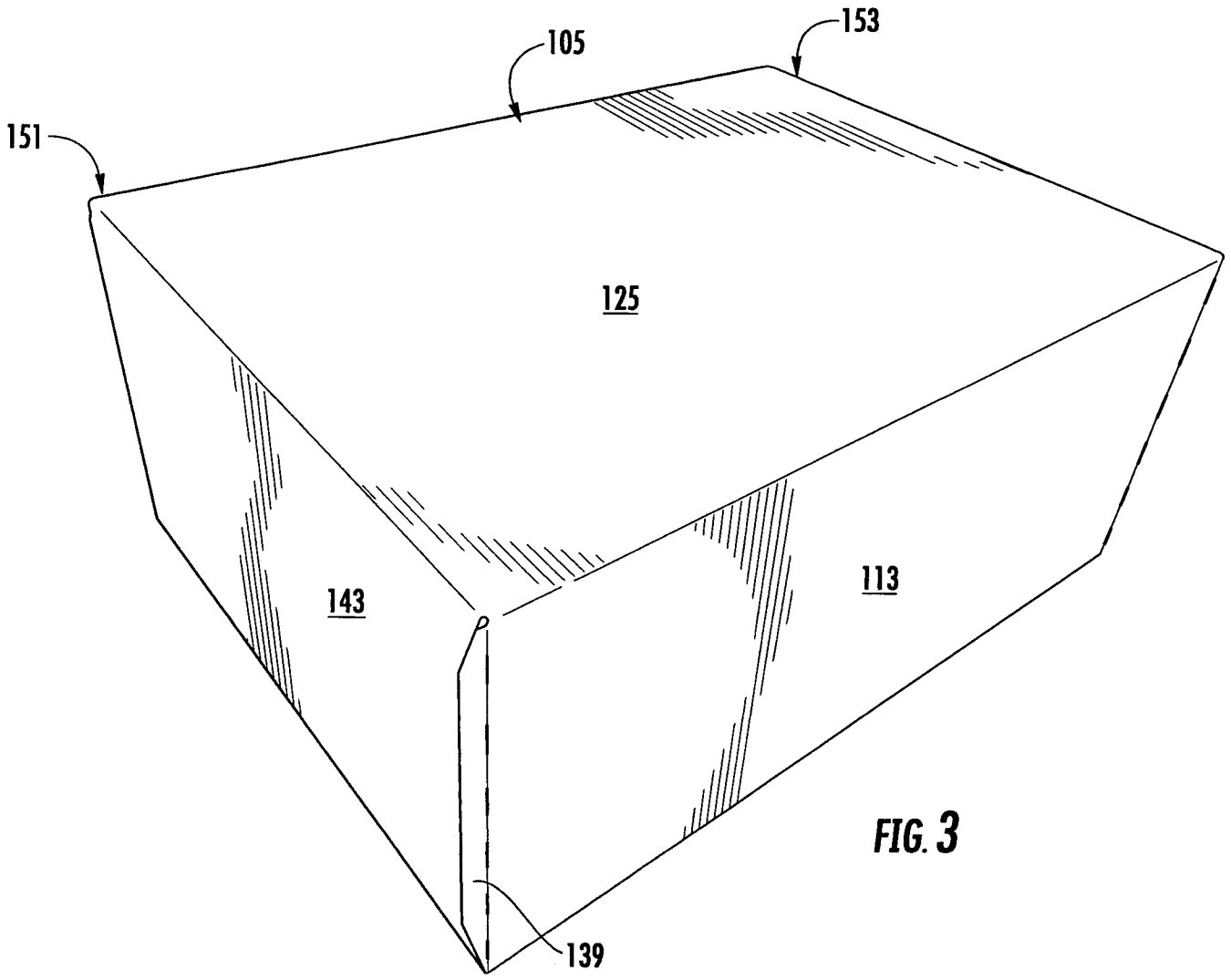
FIG. 3 is a perspective of an assembled carton of the first embodiment.

As shown in FIGS. 3 and 4, the first end 151 is closed by first inwardly folding the side end flaps 135, 139. The bottom end flap 131 is upwardly folded and the top end flap 143 is downwardly folded to close the end 151 of the carton 105. In one embodiment, the second end 153 is closed in a similar manner as the first end 151. The bottom end flap 133 is upwardly folded and the second top end flap 145 is downwardly folded to close the end 153 of the carton 105.

In the first embodiment, the loaded and closed carton 105 of FIG. 4 is further processed so that the article protection flaps 171 are activated. The access features 189 are adjacent to and in alignment with the article protection flaps 171 such that the article protection flaps 171 are engaged through the bottom access features 189 and moved to a position where the flaps 171 are located between the containers C. The engaged article protection flaps 171 tighten the packing of the container C in the carton 105 which helps minimize article breakage. The article protection flaps 171 are foldably connected to the bottom panel 109 and moveable between a first position (FIG. 5) that is substantially parallel to the bottom panel 109 and a second position (FIGS. 6-7) wherein the article protection flaps 171 are folded relative to the bottom panel 109 and are located between adjacent containers C. In one embodiment, the article protection flaps 171 are raised or activated to the position of FIG. 7, and the article protection flaps 171 have features for preventing the folding of the article protection flaps 171 from the second position back to the first position. It is understood that the article protection flaps 171 will be activated to the second position (FIGS. 6-7) after the ends 151, 153 of the carton 105 have been closed. Alternatively, the article protection flaps 171 could be activated prior to closing one or both of the ends 151, 153 of the carton 105 without departing from the disclosure.

Figure 6:
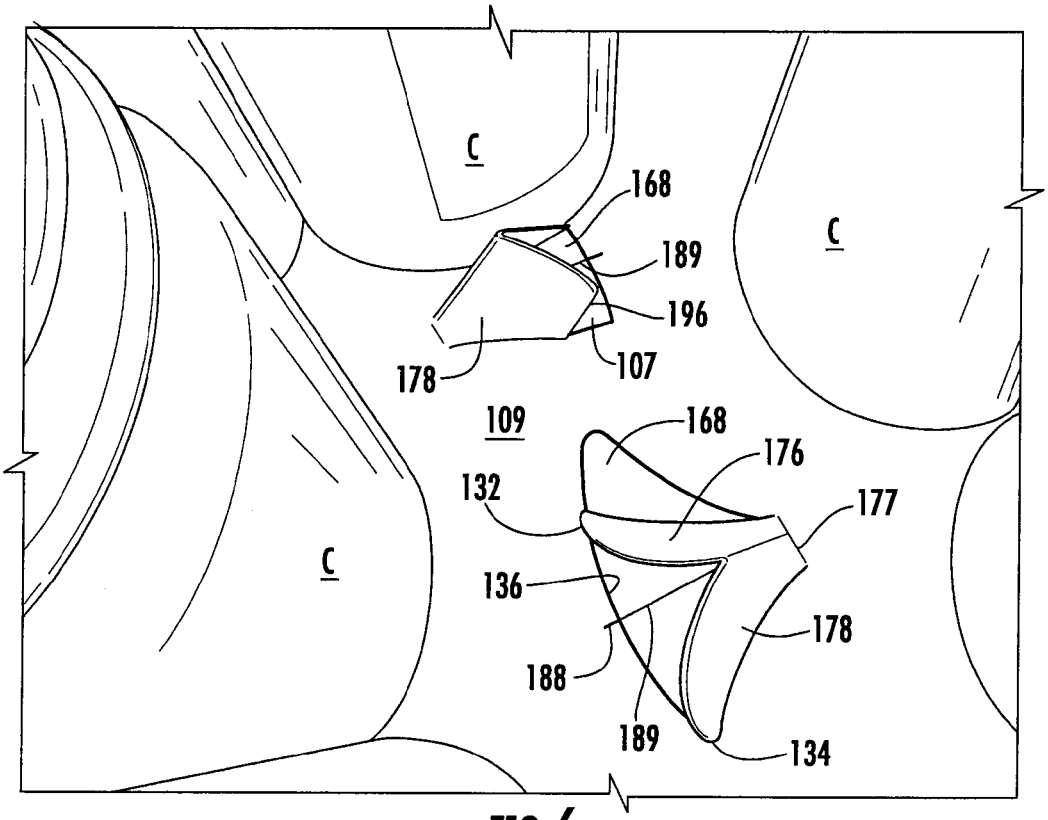
FIG. 6 is a perspective view of the interior surface of the bottom panel of the carton of the first embodiment showing the article protection flaps in a second position.
Figure 7:
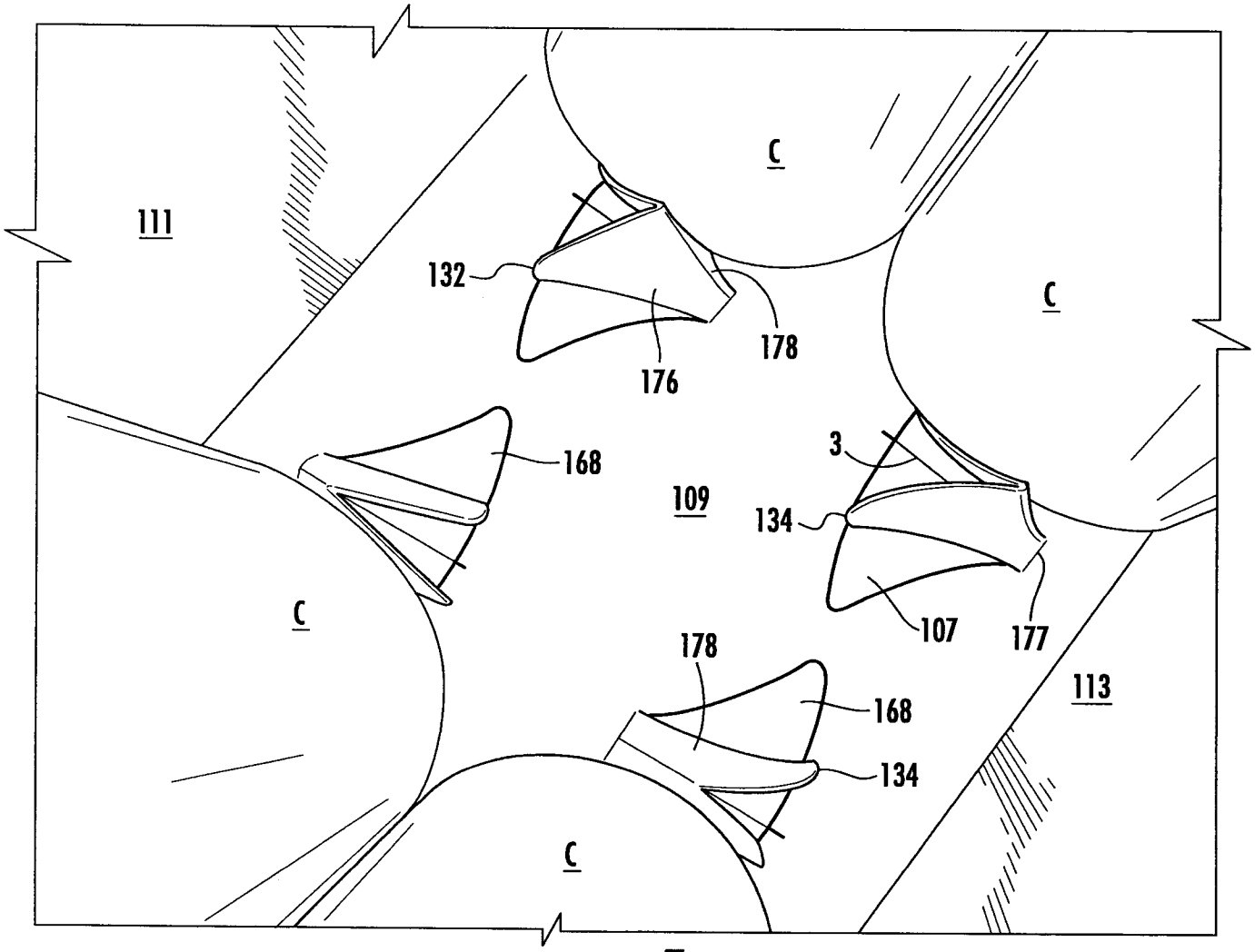
FIG. 7 is a perspective view of the interior surface of the bottom panel of the carton of the embodiment showing the article protection flaps in a second position.
Figure 8:
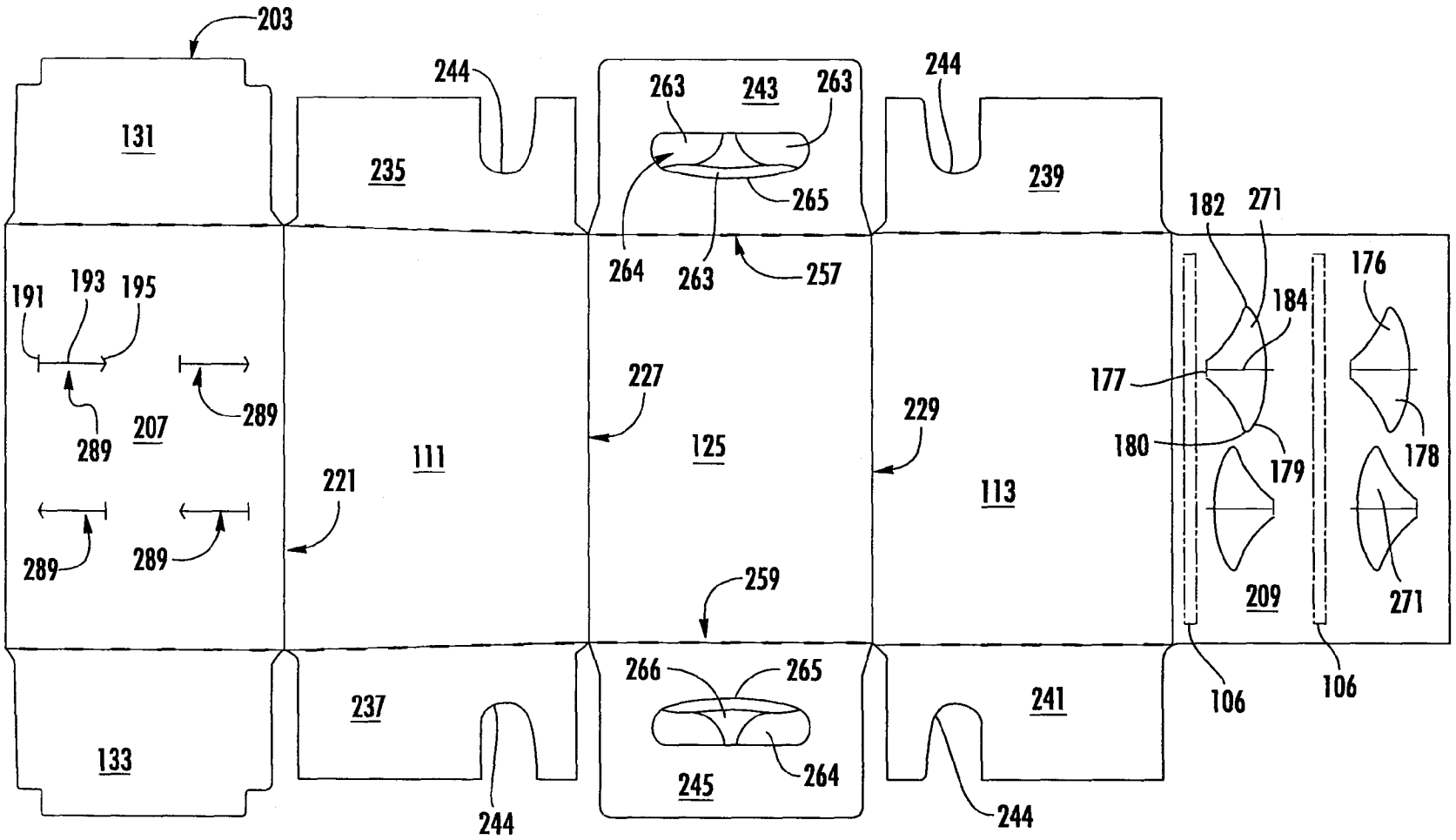
FIG. 8 is a plan view of an exterior surface of a blank for forming a carton according to a second embodiment of the disclosure.
Figure 9:
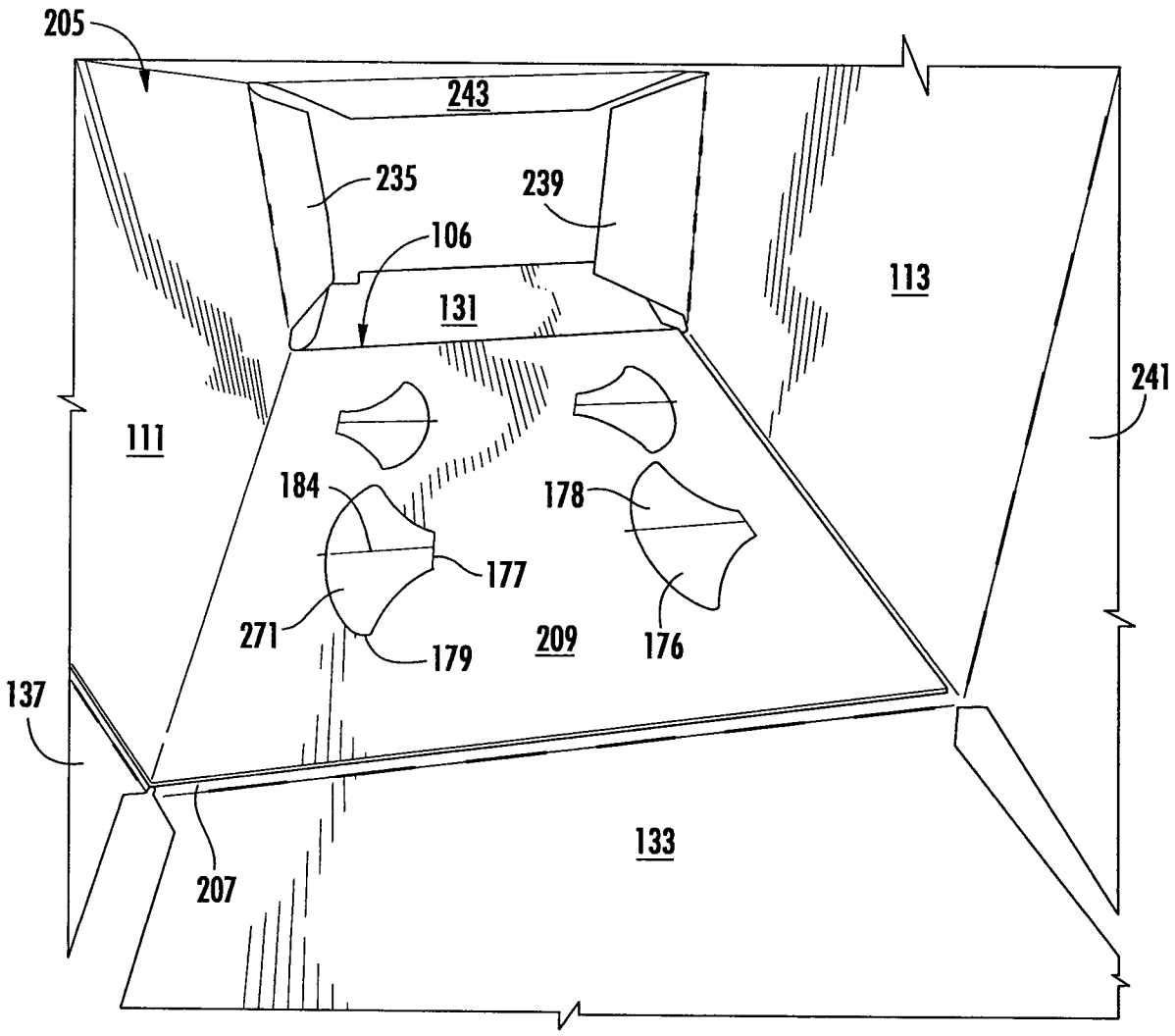
FIG. 9 is an end perspective of the partially assembled carton of the second embodiment.
Figure 10:
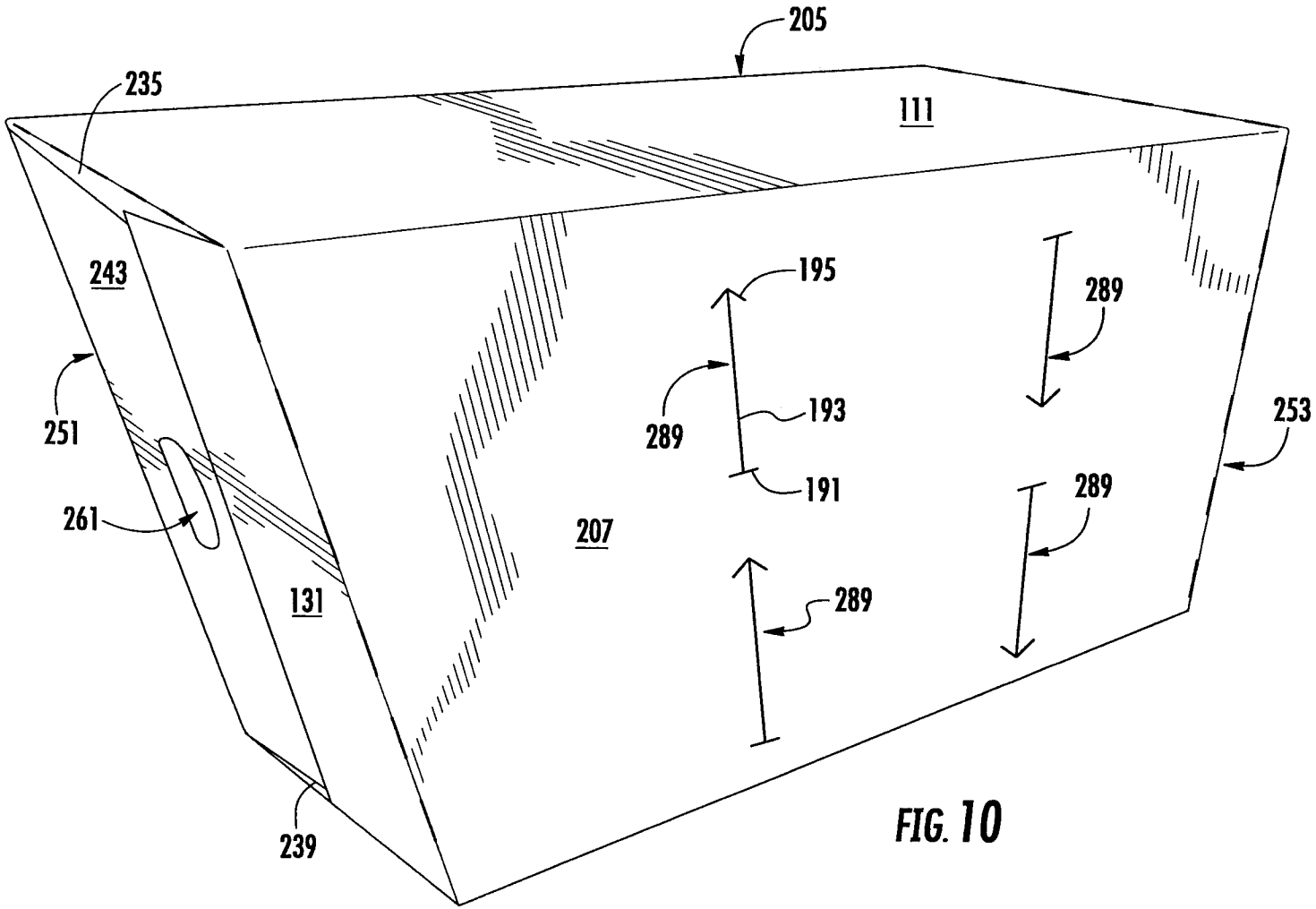
FIG. 10 is a side perspective of an assembled carton of the second embodiment showing access features.
Figure 11:
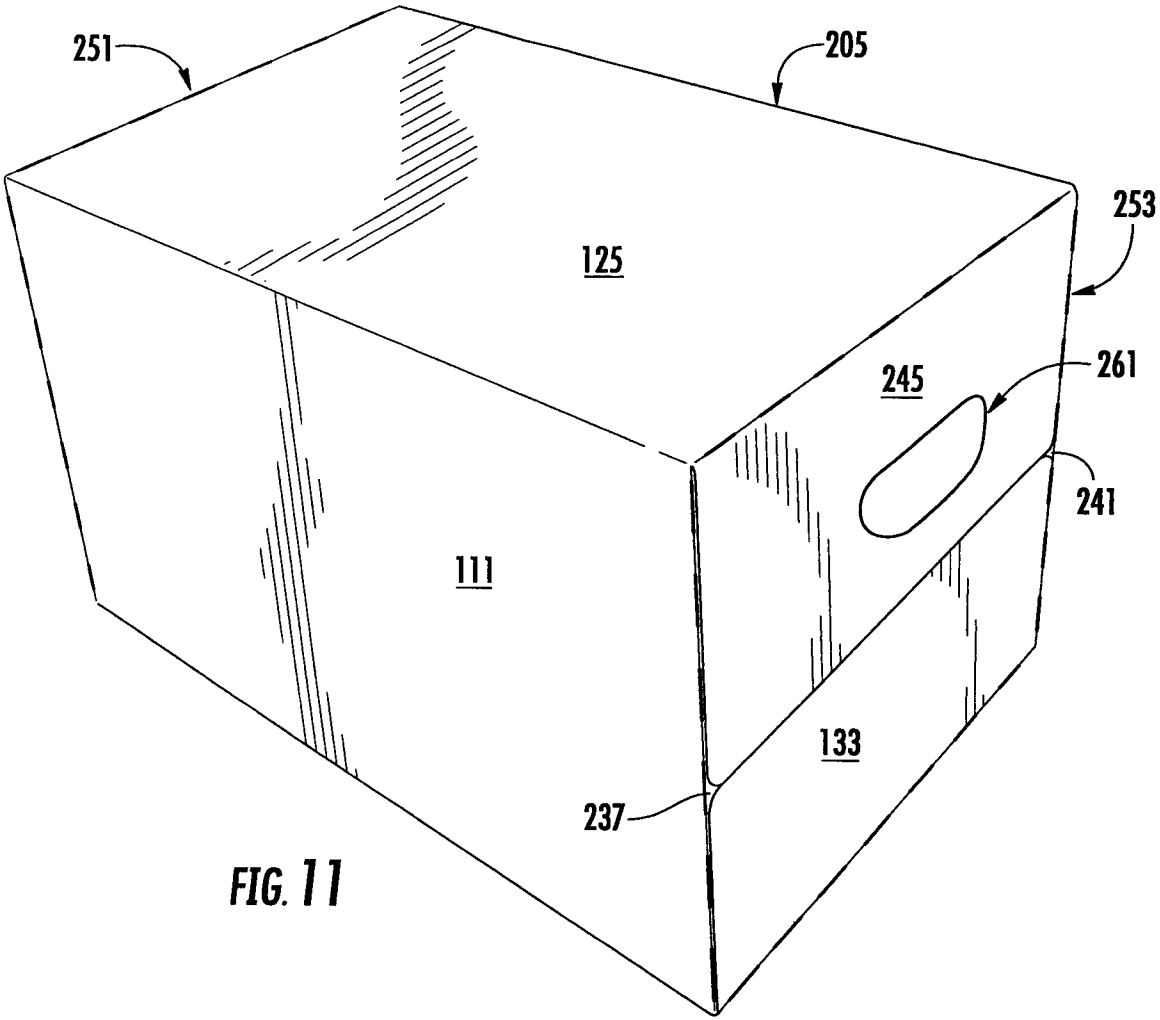
FIG. 11 is a side perspective of an assembled carton of the second embodiment.

The article protection flaps 171 can be accessed through the access feature 189 by an actuator of a carton forming machine, some of which will be described below in further detail. The activation of a single article protection flap 171 will be described in detail herein, but it is understood that the other article protection flaps can be activated in a similar or different manner without departing from the disclosure. FIGS. 5 and 6 are enlarged portions of the interior surface 108 of the bottom panel 109, with FIG. 5 showing the interior surface of the bottom panel 109 prior to activation of the article protection flap 171, and FIG. 6 showing the interior of the bottom panel 109 after activation of the article protection flap 171 with a container C removed to show the positioning of the article protection flaps. In one embodiment, the actuator for forming the article protection flap 171 presses through second bottom panel 107 via the access feature 189 and presses against the fold line 187 (FIG. 5) of the article protection flap 171 to initiate separation of the article protection flap from the bottom panel 109 along the cut 179. As shown in FIGS. 6 and 7, the article protection flap 171 is pivoted upward relative to the bottom panel 109 at the fold line 177. As the article protection flap 171 is activated, the first portion 176 and the second portion 178 are folded relative to each other. In one embodiment, the first portion 176 and the second portion 178 of the article protection flap 171 are folded inwardly along second fold line 184. As such, the article protection flap 177 provides two layers of material (e.g., the inwardly folded first portion 176 and second portion 178) between adjacent containers C in the carton 105.

In one embodiment, the upwardly folding of the article protection flaps 171 causes the containers C in the carton 105 to move to accommodate the space required for the article protection flaps in the second position with the first portion 176 and second portion 178 folded relative to each other. The movement of the containers C when the article protection flaps 171 are upwardly folded and located between adjacent containers, tightens the packing of the containers in the carton 105 so that the movement of the containers is limited by the positioning of the article protection flaps 171 and the respective end flaps 131, 135, 139, 143 and 133, 137, 141, 145 at the closed ends 151, 153 of the carton 105. The article protection flaps 171 are pressed against two adjacent containers C to initiate movement of the containers and provide the tightening feature of the article protection flaps 171.

In one embodiment, the configuration of the first portion 176 and the second portion 178 prevents the article protection flap 171 from being downwardly folded from the second or raised position of FIG. 6 to the first or lowered position as shown in FIG. 5, when the first portion 176 and the second portion 178 of the article protection flap 171 are inwardly folded relative to each other. Also, an edge 134 of the second portion 178 of the article protection flap 171 formed by the rounded corner 182 of the cut 183 extends beyond the edge of the opening 168. The positioning of the distal portions of the first portion 176 and second portion 178, including the edges 132, 134 of the article protection flap 171, relative to the edge 136 of the opening 168 prevents the article protection flaps 171 from being downwardly folded to the first position wherein the article protection flaps 171 are substantially parallel to the bottom panel 109. As such, once the article protection flaps 171 are raised to the second position and positioned between adjacent containers C, the article protection flaps stay in the upwardly folded position providing cushioning and protection between adjacent containers. In the embodiment of FIGS. 1-7, the article protection flaps 171 of the two outer rows have a straight corner 196 that is truncated compared to the rounded corners 180, 182. The article protection flaps 171 could be otherwise shaped, arranged, and/or configured to have other features for preventing the article protection flaps from returning to the first or lowered position without departing from the disclosure.

FIGS. 8-11 illustrate an alternative embodiment of the disclosure that is similar to the blank 103 of the first embodiment. Accordingly, like or similar features will be indicated with like or similar reference numbers. The blank 203 is for forming a carton 205 having article protection flaps 271 foldably connected to the first bottom panel 209 and access features 289 in the second bottom panel 207 of the carton 205 as discussed above for the first embodiment. In the embodiment of FIGS. 8-11, the article protection flaps 271 and access features 289 are arranged in a 2×2 configuration. The blank 203 has handle features 264 for forming a handle 261. In the illustrated embodiment, the handle features comprise handle flaps 263 foldably connected to a respective top end flap 243, 245 at a longitudinal fold line 265, and notches or openings 244 in the side end flaps 235, 239, 237, and 241. The openings 266 cooperate to provide an opening at a respective closed end 251, 253 to allow a respective handle flap 263 to be inwardly folded so that the carton 205 can be grasped at a respective end. The blank 203 can have other features for forming the handle 261, or the blank and/or carton 205 can have a handle that is alternatively shaped, arranged, and/or configured without departing from the disclosure. Further, the handle 261 can be omitted without departing from the disclosure. The blank 203 could have other features and could be otherwise shaped, arranged, and/or configured without departing from the disclosure.

Figure 12:
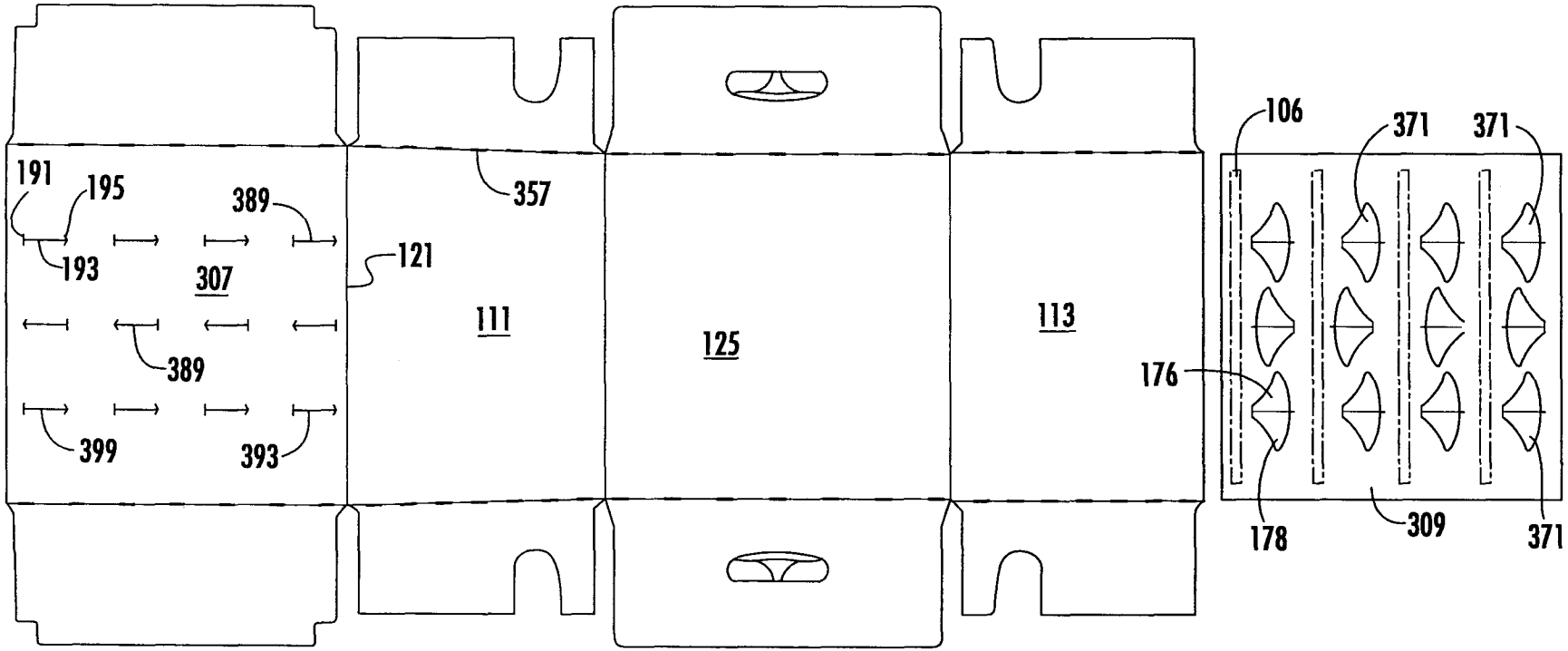
FIG. 12 is a plan view of an exterior surface of a blank for forming a carton according to a third embodiment of the disclosure.
Figure 13:
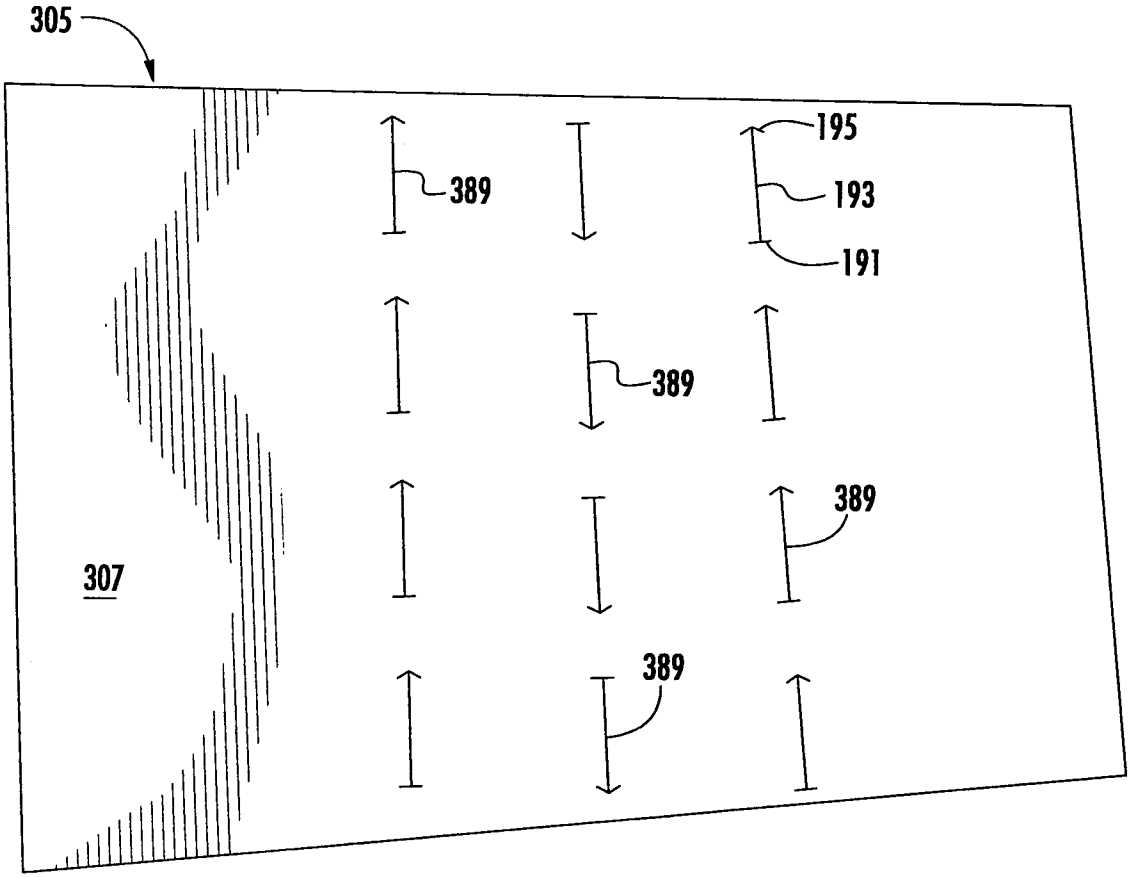
FIG. 13 is a plan view of a second bottom panel of the carton of the embodiment of FIG. 12 showing the access features.
Figure 14:
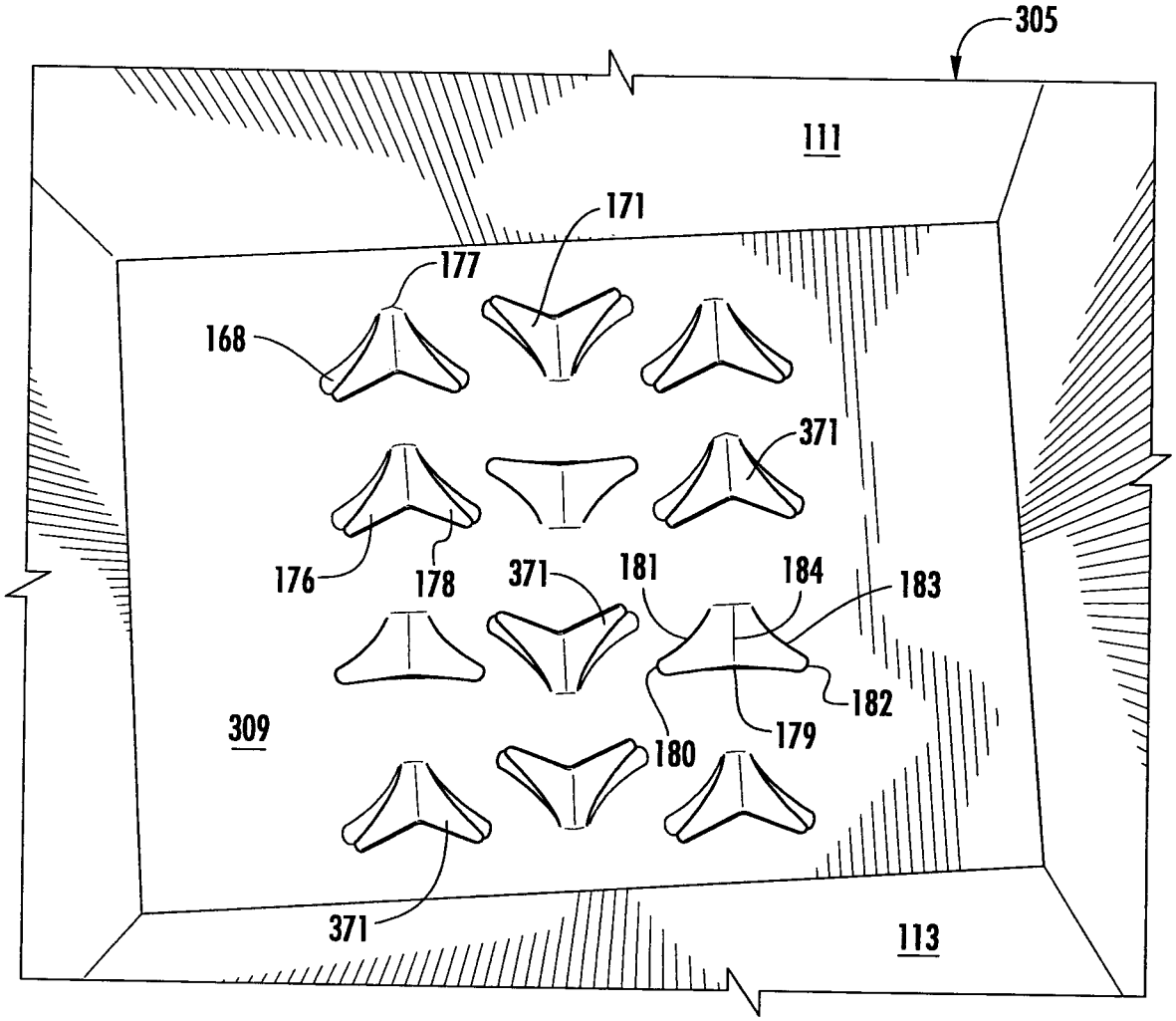
FIG. 14 is a plan view of a first bottom panel of the carton of the embodiment of FIG. 12 with the article protection flaps in the first position.

FIGS. 12-14 illustrate a blank 303 and carton 305 of a third embodiment of the disclosure that is similar to the blank 103 of the first embodiment, but the bottom panel 109 is detached and replaced with an insert 309 with article protection flaps 371 arranged in a 4×3 configuration. The insert 309 is inserted into the erected carton 305 and placed in face-to-face contact with the bottom panel 307 before inserting the containers C. The bottom panel 307 comprises twelve access features 389 arranged in a 4×3 configuration for registration with the article protection flaps 371. Accordingly, like or similar features will be indicated with like or similar reference numbers between the embodiments. The article protection flaps 371 and access features 389 can otherwise be shaped, arranged, and configured without departing from the disclosure.

The cartons of any of the illustrated or non-illustrated embodiments of the disclosure could have other features (e.g., dispenser features, handle features, reinforcement features, etc.) without departing from the disclosure. Also, the cartons could be otherwise shaped, arranged, or configured and the cartons could be configured to hold articles other than beverage containers without departing from the disclosure.

In general, the blanks of any of the illustrated or non-illustrated embodiments may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton containing a plurality of articles, the carton comprising a plurality of panels at least partially forming an interior of the carton, the plurality of panels comprising a first bottom panel, a first side panel foldably connected to the first bottom panel, a top panel foldably connected to the first side panel, a second side panel foldably connected to the top panel, and a second bottom panel, the first bottom panel and the second bottom panel being in face-to-face contact to at least partially form the interior of the carton, a first plurality of end flaps respectively foldably connected to respective panels of the plurality of panels, and a second plurality of end flaps respectively foldably connected to respective panels of the plurality of panels, the first plurality of end flaps being at least partially overlapped to close a first end of the carton, and the second plurality of end flaps being at least partially overlapped to close a second end of the carton, the plurality of articles comprises at least a first article and a second article that are adjacent and in the interior of the carton, the first bottom panel comprising at least one article protection flap foldably connected to the first bottom panel and moveable between a first position that is substantially parallel to the first bottom panel and a second position wherein the at least one article protection flap is folded relative to the first bottom panel into the interior of the carton and into contact with the first article and the second article such that the first bottom panel comprises an opening when the at least one article protection flap is in the second position, the at least one article protection flap comprising a first flap portion and a second flap portion foldably connected to the first flap portion at a fold line, in the second position the first flap portion and the second flap portion are folded relative to each other and the first flap portion contacts at least the first article and the second flap portion contacts at least the second article, and the second bottom panel comprising at least one access feature for positioning the at least one article protection flap from the first position to the second position, the at least one access feature comprising a cut to allow access to the at least one article protection flap through the cut, the second bottom panel substantially covers the opening when the at least one article protection flap is in the second position.

2. The carton of claim 1, wherein the at least one access feature is in registration with the at least one article protection flap.

3. The carton of claim 1, wherein the first bottom panel is in contact with a bottom of the at least one article.

4. The carton of claim 1, wherein the at least one article protection flap has features for preventing folding of the at least one article protection flap from the second position to the first position.

5. The carton of claim 4, wherein the first bottom panel comprises an opening having an opening edge at least partially formed by a line of weakening defining at least a portion of the at least one article protection flap, and the features for preventing folding of the at least one article protection flap comprise a free edge of at least one of the first flap portion and the second flap portion that extends beyond the opening edge.

6. The carton of claim 1, wherein the at least one article protection flap comprises a plurality of article protection flaps, the at least one access feature comprises a plurality of access features, the first article comprises a plurality of first articles, the second article comprises a plurality of second articles, and each article protection flap of the plurality of article protection flaps is positioned between a respective first article and a respective second article of the plurality of articles.

7. The carton of claim 1, wherein the first bottom panel is in contact with a bottom of the plurality of articles, and the top panel is adjacent a top of the plurality of articles.

8. The carton of claim 1, wherein the first bottom panel is an insert in face-to-face contact with the second bottom panel.

9. The carton of claim 1, wherein the cut is a first portion of the at least one access feature, the at least one access feature further comprising a second portion perpendicular to the first portion.

10. The carton of claim 9, wherein the at least one access feature further comprises a third portion oblique to the first portion.

11. A blank for forming a carton for containing at least one article, the blank comprising a plurality of panels for at least partially forming an interior of the carton formed from the blank, the plurality of panels comprising a first panel and a second panel, the first panel and the second panel are for being in face-to-face contact to at least partially form the interior of the carton formed from the blank, the first panel comprising at least one article protection flap foldably connected to the first panel and moveable between a first position that is substantially parallel to the first panel and a second position wherein the at least one article protection flap is folded relative to the first panel such that the first bottom panel comprises an opening when the at least one article protection flap is in the second position, the at least one article protection flap has features for preventing folding of the at least one article protection flap from the second position to the first position comprising a first flap portion of the at least one article protection flap and a second flap portion of the at least one article protection flap foldably connected to the first flap portion at a fold line, the first flap portion and the second flap portion are for being folded relative to each other when the article protection flap is in the second position in the carton formed from the blank, in the second position the first flap portion is in contact with at least a first article, the second flap portion is in contact with at least a second article in the carton formed from the blank, and the second panel comprising at least one access feature for positioning the at least one article protection flap from the first position to the second position, the at least one access feature comprising a cut to allow access to the at least one article protection flap through the cut in the carton formed from the blank, the second panel is for substantially covering the opening when the carton is formed from the blank and the at least one article protection flap is in the second position.

12. The blank of claim 11, wherein the at least one access feature is positioned in the second panel for registration with the at least one article protection flap in the carton formed from the blank.

13. The blank of claim 11, wherein the first panel comprises a line of weakening at least partially defining the at least one article retention flap, the line of weakening forming an opening having an opening edge in the carton formed from the blank, the features for preventing folding of the article protection flap comprise a free edge of at least one of the first flap portion and the second flap portion that extends beyond the opening edge in the carton formed from the blank.

14. The blank of claim 11, wherein the at least one article protection flap comprises a plurality of article protection flaps, the at least one access feature comprises a plurality of access features, the at least one article comprises a plurality of adjacent articles, and each article protection flap of the plurality of article protection flaps is for being positioned between two respective adjacent articles of the plurality of articles in the carton formed from the blank.

15. The blank of claim 11, wherein the first panel is a first bottom panel, the second panel is a second bottom panel, the first bottom panel is for being in contact with a bottom of the at least one article in the carton formed from the blank, the plurality of panels comprises a first side panel foldably connected to the first bottom panel, a top panel foldably connected to the first side panel, and a second side panel foldably connected to the top panel, the top panel being adjacent a top of the at least one article in the carton formed from the blank.

16. The blank of claim 11, further comprising a plurality of end flaps respectively foldably connected to respective panels of the plurality of panels, the plurality of end flaps being at least partially overlapped to close an end of the carton.

17. The blank of claim 11, wherein the at least one access feature comprises a tear line that is in registration with the at least one article protection flap to allow access to the at least one article protection flap through the tear line.

18. The blank of claim 11, wherein the cut is a first portion of the at least one access feature, the at least one access feature further comprising a second portion perpendicular to the first portion.

19. The carton of claim 18, wherein the at least one access feature further comprises a third portion oblique to the first portion.

20. A method of forming a carton, the method comprising:

obtaining a blank comprising a plurality of panels comprising a first bottom panel, a first side panel foldably connected to the first bottom panel, a top panel foldably connected to the first side panel, a second side panel foldably connected to the top panel, and a second bottom panel, a first plurality of end flaps respectively foldably connected to respective panels of the plurality of panels at a first end of the blank and a second plurality of end flaps respectively foldably connected to respective panels of the plurality of panels at a second end of the blank, the first bottom panel comprising at least one article protection flap foldably connected to the first bottom panel, and the second bottom panel comprising at least one access feature, the at least one article protection flap comprising a first flap portion and a second flap portion foldably connected to the first flap portion at a fold line, the at least one access feature comprising a cut;

positioning the plurality of panels to at least partially form an interior of the carton comprising positioning the first bottom panel and the second bottom panel to be in face-to-face contact and forming a sleeve having a first sleeve end and a second sleeve end;

loading a plurality of articles in the interior of the carton, the plurality of articles comprising at least a first article and a second article adjacent the first article;

closing the first sleeve end by at least partially overlapping the first plurality of end flaps and closing the second sleeve end by at least partially overlapping the second plurality of end flaps;

accessing the at least one article protection flap through the cut and positioning the at least one article protection flap relative to the first bottom panel after the loading the plurality of articles, the positioning comprising moving the article protection flap from a first position that is substantially parallel to the first bottom panel to a second position wherein the at least one article protection flap is folded relative to the first bottom panel into the interior of the carton and into contact with the first article and the second article such that an opening is formed in the first bottom panel and the second panel substantially covers the opening, the moving the article protection flap from the first position to the second position comprising folding the first flap portion and the second flap portion relative to each other at the fold line, positioning the first flap portion in contact with at least the first article and the second flap portion in contact with at least the second article, and moving the first article and the second article to accommodate the article protection flap between the first article and second article to tighten the loading the plurality of articles.

21. The method of claim 20, wherein the positioning the plurality of panels comprises placing the at least one access feature in registration with the at least one article protection flap.

22. The method of claim 20, wherein the loading the plurality of articles comprises placing a bottom of the plurality of articles in contact with the first bottom panel.

23. The method of claim 20, wherein the at least one article protection flap has features for preventing folding of the article protection flap from the second position to the first position.

24. The method of claim 23, wherein the accessing the at least one article protection flap comprises engaging the at least one article protection flap with an actuator of a carton forming machine, the actuator being inserted through the at least one access feature to initiate the folding of the at least one article protection flap.

25. The method of claim 23, wherein the folding the at least one article protection flap comprises forming an opening in the first bottom panel, the opening having an opening edge at least partially formed by a line of weakening defining at least a portion of the at least one article protection flap, and the features for preventing folding of the article protection flap comprise a free edge of at least one of the first portion and the second portion that extend beyond the opening edge.

26. The method of claim 20, wherein the loading the at least one article comprises loading a plurality of adjacent articles, the at least one article protection flap comprises a plurality of article protection flaps, the at least one access feature comprises a plurality of access features, and the folding the at least one article protection flap comprises respectively positioning each article protection flap of the plurality of article protection flaps between respective adjacent articles of the plurality of articles.

27. The method of claim 20, wherein the first bottom panel is in contact with a bottom of the plurality of articles, and the top panel is adjacent a top of the plurality of articles.

* * * * *